US006426592B2

(12) United States Patent
Nishida et al.

(10) Patent No.: US 6,426,592 B2
(45) Date of Patent: Jul. 30, 2002

(54) HIGH-VOLTAGE DISCHARGE LAMP WITH CYLINDRICAL MEMBER TO MITIGATE THERMAL STRESS

(75) Inventors: Kazuhisa Nishida; Yasushi Aoki, both of Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/740,855

(22) Filed: Dec. 21, 2000

(30) Foreign Application Priority Data

Dec. 28, 1999 (JP) ..... 11-377294

(51) Int. Cl.[7] ..... H01J 19/58; H01J 19/60
(52) U.S. Cl. ..... 313/623; 313/331
(58) Field of Search ..... 313/623, 624, 313/625, 331, 332

(56) References Cited

U.S. PATENT DOCUMENTS 4,550,269 A * 10/1985 Dixon ..... 313/331
4,749,905 A * 6/1988 Mori et al. ..... 313/623
5,200,669 A 4/1993 Dixon et al. ..... 313/623
5,461,277 A 10/1995 Van Gennip et al. ..... 313/331

* cited by examiner

*Primary Examiner*—Michael H. Day
(74) *Attorney, Agent, or Firm*—McGinn & Gibb, PLLC

(57) ABSTRACT

A high-voltage discharge lamp has a bulb made of quartz glass, a pair of electrodes and molybdenum foils, wherein the pair of electrodes are arranged so as to oppose each other and are joined to respective ones of the molybdenum foils, and the bulb and molybdenum foils are hermetically sealed at seal portions of the bulb. The joints between the pair of electrodes and the respective molybdenum foils are covered by cylindrical members having slits on an outer surface and/or an inner surface thereof.

13 Claims, 2 Drawing Sheets

FIG.1
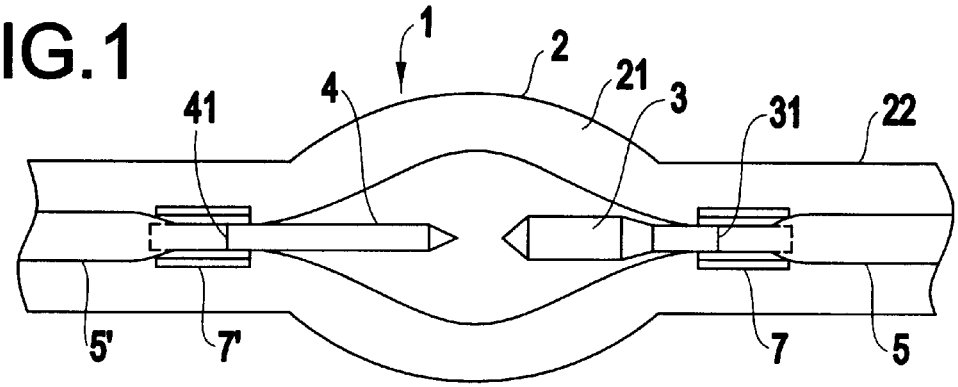
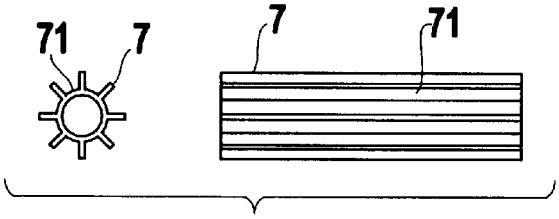
FIG.2
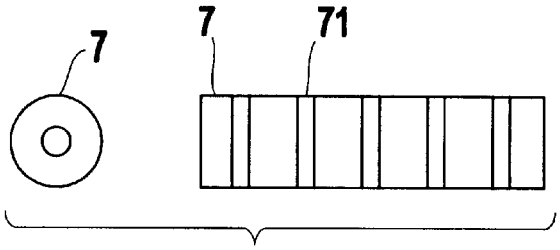
FIG.3
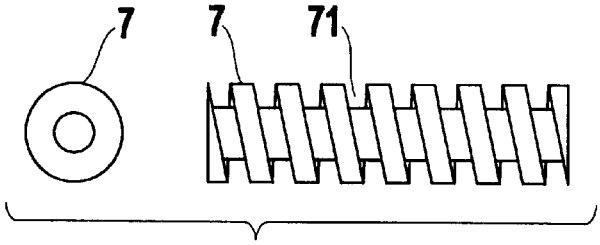
FIG.4

HIGH-VOLTAGE DISCHARGE LAMP WITH CYLINDRICAL MEMBER TO MITIGATE THERMAL STRESS

FIELD OF THE INVENTION

This invention relates to a high-voltage discharge lamp and, more particularly, to a high-voltage discharge lamp in which it is possible to prevent a quartz-glass bulb from bursting at the time of high-temperature thermal processing or at the time of operation.

BACKGROUND OF THE INVENTION

A high-voltage discharge lamp according to the prior art has a structure of the kind shown in FIG. 6, by way of example. Specifically, a high-voltage discharge lamp 1 includes a quartz-glass bulb 2, which comprises an enlarged portion 21 that provides a light-emitting space and a seal portion 22, and a pair of opposing electrodes (an anode 3 and cathode 4) disposed within the glass bulb 2. The anode 3 and cathode 4 are joined to the molybdenum foils 5 and 5', respectively, by means such as welding. Further, the molybdenum foils 5, 5' are hermetically sealed within the bulb 2 at the seal portions 22 thereof. The enlarged portion 21 having the light-emitting space is filled with a discharge gas or the like.

Coils 6, 6' comprising a material such as tungsten, tantalum or molybdenum are wound on the anode 3 and cathode 4, respectively, on or near the joints between these electrodes and the molybdenum foils 5, 5'. By winding the coils 6, 6' on the electrodes, stress applied to the glass bulb 2 owing to thermal expansion of the electrodes 3, 4 can be mitigated even in a case where thermal processing is applied at high temperature or when the high-voltage lamp is operated. As a result, it is possible to prevent cracking at the portions where the electrodes 3 and 4 contact the glass bulb 2.

SUMMARY OF THE DISCLOSURE

In the course of the investigations toward the present invention, it has turned out that there is much to be desired in the art.

When the coils are wound on the electrodes, however, protrusions are produced at the leading and trailing ends of the coils and the protrusions scratch the glass bulb. As a consequence, the glass bulb tends to crack. Further, when the coils are wound on the electrodes, a load (tensile force) acts upon the electrodes. If an electrode has a diameter of 0.6 to 0.8 mm, therefore, the electrode is deformed. It is technically very difficult to eliminate these protrusions and to prevent the deformation of the electrodes. Furthermore, a high-voltage discharge lamp of this kind cannot discharge stably and sufficiently stable brightness cannot be obtained.

Accordingly, an object of the present invention is to provide a high-voltage discharge lamp in which it is possible to eliminate the scratching of a quartz-glass bulb and the deformation of electrodes,and to mitigate thermal stress at the time of high-temperature thermal processing and high-voltage discharge operation, as a result of which the occurrence of cracking can be prevented and sufficiently stable brightness can be obtained.

As a result of extensive research, the inventor has devised a high-voltage discharge lamp in which the joint, as well as the vicinity thereof, between at least one electrode and molybdenum foil is covered by a cylindrical member the outer and/or inner surface of which has slits, or by a mesh-like member. The inventor has found that such a high-voltage discharge lamp will no longer have its quartz-glass bulb scratched, that the electrode will no longer be deformed because it is unnecessary for the joint or the vicinity thereof to have a hermetic seal, that it is possible to mitigate thermal stress at the time of high-temperature thermal processing or high-voltage discharge operation, thereby preventing the occurrence of cracking, and that sufficiently stable brightness is obtained. The present invention has been perfected on the basis of these findings.

Specifically, according to the present invention, the foregoing object is attained by providing a high-voltage discharge lamp having a bulb made of quartz glass, a pair of electrodes and molybdenum foils, wherein the pair of electrodes are arranged so as to oppose each other and are joined to respective ones of the molybdenum foils, and the bulb and molybdenum foils are hermetically sealed at seal portions of the bulb, characterized in that joints, as well as the vicinities thereof, between the pair of electrodes and the molybdenum foils are covered by cylindrical members having slits on an outer surface and/or an inner surface thereof.

According to another aspect of the present invention, the foregoing object is attained by providing a high-voltage discharge lamp having a bulb made of quartz glass, a pair of electrodes and molybdenum foils, wherein the pair of electrodes are arranged so as to oppose each other and are joined to respective ones of the molybdenum foils, and the bulb and molybdenum foils are hermetically sealed at seal portions of the bulb, characterized in that joints, as well as the vicinities thereof, between the pair of electrodes and the molybdenum foils are covered by mesh-like members.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 1 is a diagram illustrating a high-voltage discharge lamp according to an embodiment of the present invention;

FIG. 2 is a diagram illustrating an embodiment of a cylindrical member for the high-voltage discharge lamp of the present invention;

FIG. 3 is a diagram illustrating an embodiment of a cylindrical member for the high-voltage discharge lamp of the present invention;

FIG. 4 is a diagram illustrating an embodiment of a cylindrical member for the high-voltage discharge lamp of the present invention;

PREFERRED EMBODIMENTS OF THE INVENTION

Figure 5A:
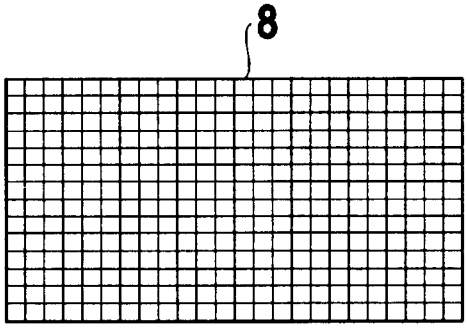
FIG. 5 is a diagram illustrating an embodiment of a mesh-like member for the high-voltage discharge lamp of the present invention.

Preferred embodiments of the present invention will now be described with reference to the drawings.

FIG. 1 is a diagram illustrating a high-voltage discharge lamp according to an embodiment of the present invention.

As shown in FIG. 1, a bulb 2 made of quartz glass may be one obtained naturally or synthetically. The bulb 2 may be integrally molded or may be produced by adhering two or more layers together. The shape of the enlarged or bulged portion (bulb portion) 21 that provides the light-emitting space may be spherical or ellipsoid. An anode 3 and cathode 4 preferably consist of tungsten, molybdenum or tantalum, with tungsten being particularly preferred. There is no particular limitation concerning the spacing between these electrodes. The anode 3 and cathode 4 are joined to molybdenum foils 5 and 5', respectively, by means such as welding. The molybdenum foils 5, 5' are hermetically sealed within the bulb 2 at the seal portions 22 thereof. The enlarged portion 21 having the light-emitting space is filled with a discharge gas or the like.

Cylindrical members 7, 7' are disposed so as to cover joints 31, 41, as well as the vicinities thereof, between the electrodes 3, 4 and the molybdenum foils 5, 5', respectively. As long as the cylindrical members 7, 7' cover the joints 31, 41, respectively, and the vicinities thereof, there is no particular limitation relating to the axial lengths of the cylindrical members, the lengths of the covered portions of the electrodes and the lengths of the covered portions of the molybdenum foils. In FIG. 1, the cylindrical members cover the joints 31, 41, as well as the vicinities thereof, between both electrodes and both molybdenum foils. However, an arrangement in which only one of the joints 31, 41 and the vicinity thereof is covered may be adopted. It is preferred that the cylindrical members 7, 7' be embedded only in the seal portion 22 and not be exposed to the enlarged portion 21. Further, the cylindrical members 7, 7' need not have a hermetic seal with respect to both electrodes and molybdenum foils. The cylindrical members 7, 7' preferably consist of tungsten, molybdenum or tantalum, with tungsten being particularly preferred.

The cylindrical members 7, 7' have slits 71 provided on their outer and/or inner surfaces. The slits 71 mitigate thermal stress at the time of high-temperature thermal processing and at operation of the high-voltage discharge lamp, thereby making it possible to prevent the occurrence of cracking.

FIGS. 2 to 4 illustrate embodiments of the cylindrical member 7 the outer surface of which is provided with the slits 71. The slits 71 extend axially of the cylindrical member 7 in FIG. 2, circumferentially of the cylindrical member 7 in FIG. 3 and helically of the cylindrical member 7 in FIG. 4. In another arrangement, which is not illustrated, the slits may be provided both axially and circumferential y of the cylindrical member 7. The arrangement of FIG. 4 in which the slits 71 have the helical configuration is particularly preferred. The slits may be provided on the inner or outer surface of the cylindrical member or on both the inner and outer surfaces. If the slits are provided on the inner surface, it is possible to prevent a decline in the slidability of the cylindrical member at the time of high-temperature thermal processing and at operation of the high-voltage discharge lamp. This has the effect of mitigating thermal stress.

In a case where the slits are provided so as to extend in the axial direct ion (FIG. 2) or circumferential direction (FIG. 3), there is no particular limitation concerning the number of slits. If the slits are provided in the form of the helical configuration (FIG. 4), there is no particular limitation concerning the helical pitch. Further, there is no limitation concerning the width and depth of the slits. There is also no particular limitation relating to the cross-sectional shape of the slits, and the slits may have a rectangular, triangular, square, semi-circular or U-shaped cross-section, by way of example. In order to prevent the glass bulb from being damaged at the time of high-temperature thermal processing and at operation of the high-voltage discharge lamp, it is preferred that the edge portion of the slits be worked to have an arcuate or chamfered shape. The cylindrical member can be manufactured through any of the usual methods.

Figure 5B:
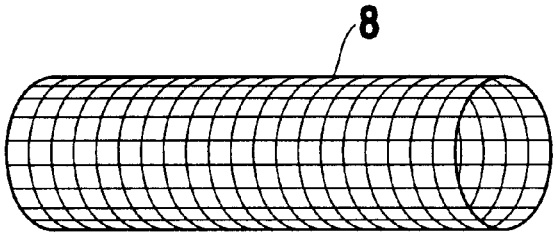
Figure 6:
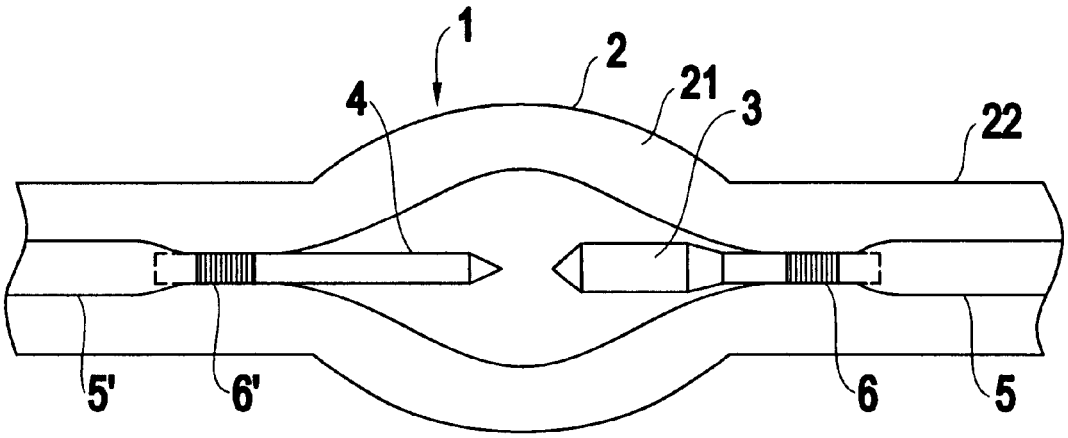
FIG.6 PRIOR ART
FIG. 6 is a diagram illustrating an example of a high-voltage discharge lamp according to the prior art.

FIG. 5A illustrates the development, on a plane, of a mesh-like member 8 that covers the joint, as well as the vicinity thereof, between an electrode and molybdenum foil, and FIG. 5B is a perspective view of the mesh-like member 8. By using the mesh-like member 8 to cover the joint, as well as the vicinity thereof, between the electrode and molybdenum foil, it is possible to obtain effects equivalent to those when the joint and its vicinity by the cylindrical member 7 described above. The mesh-like member 8 preferably consist of tungsten, molybdenum or tantalum, with tungsten being particularly preferred. The mesh-like cylindrical member 8 has a periphery composed of minute frames and is devoid of projections. This means that the glass bulb 2 will not be scratched. Since a hermetic seal is not required between the mesh-like member 8 and the joint between the electrode and molybdenum foil and its vicinity, the electrode is not deformed. As long as the mesh-like member 8 covers the joint and its vicinity, there is no particular limitation relating to the axial length of the member, the length of the covered portion-of the electrode and the length of the covered portion of the molybdenum foil. The joints and their vicinities between both electrodes and the molybdenum foils may be covered by respective ones of mesh-like members 8 or only one of the joints and the vicinity thereof may be covered by the mesh-like member 8. It is preferred that the mesh-like member 8 be embedded only in the seal portion 22 and not be exposed to the enlarged portion 21.

Though there is no particular limitation on the mesh size of the mesh-like member 8, 200 to 400 mesh (JIS) is preferred from the viewpoint of mitigating thermal stress at the time of high-temperature thermal processing and at the time of operation of the high-pressure discharge lamp. Further, though there is no particular limitation concerning the diameter of the wire material used as the mesh-like member, 20 to 100 $\mu$m is preferred from the viewpoint of mitigating thermal stress at the time of high-temperature thermal processing and at the time of operation of the high-pressure discharge lamp. The mesh-like member can be manufactured through any of the usual methods. Alternatively, a mesh-like member already available on the market can be used.

Though there is no particular limitation concerning methods of manufacturing the high-voltage discharge lamp according to the present invention, the following example of a method of manufacture is particularly preferred: First, the joint, as well as the vicinity thereof, between an electrode and molybdenum foil is inserted into the cylindrical member or mesh-like member described above. Two of these electron and foil assemblies are formed. The method of inserting the prescribed portion of the electrode into the cylindrical member or mesh-like member is not particularly limited; this can be performed by a manual operation, by way of example. Next, one of the above-described assemblies is placed on one seal portion of a quartz-glass bulb that has been formed into the approximate shape of a high-voltage discharge lamp, the interior is evacuated and then the seal portion is caused to contract and seal while this portion is subjected to high-temperature thermal processing. Next, a light-emitting substance such as mercury is introduced from the other opening into the enlarged portion 21 for the light-emitting space, the other assembly is placed on the other seal portion, the interior is filled with an inert gas under a pressure of less than one atmosphere and the seal portion is caused to contract and seal while this portion is subjected to high-temperature thermal processing. The high-voltage discharge lamp of the present invention is thus manufactured. It is preferred that the enlarged portion 21 for the light-emitting space be cooled so that the substance sealed within will not vaporize.

The following is an example of the characteristics of the high-voltage discharge lamp according to the present invention:

discharge-lamp power: 120–180 W discharge-lamp voltage: 50–100V inter-electrode distance: 1.0–2.0 mm light-emission efficiency: 40–701 m/W tube-wall load: 80 150 W/cm2 emission wavelength: 360–700 nm

The high-voltage discharge lamp according to the present invention can be used in the same manner as an ordinary high-voltage discharge lamp. That is, when the high-voltage discharge lamp is connected to a power supply, a trigger voltage is applied across the cathode and anode to initiate an electrical discharge. A prescribed brightness is obtained as a result.

The meritorious effects of the present invention are summarized as follows.

With the high-voltage discharge lamp of the present invention, the quartz-glass bulb will not be scratched, the electrodes will not be deformed and it is possible to mitigate thermal stress at the time of high-temperature thermal processing and when the high-voltage discharge lamp is operated. As a result, cracking will not occur and a sufficiently stably brightness can be obtained.

As many apparently widely different embodiments of the present invention can be made without departing from the spirit and scope thereof, it is to be understood that the invention is not limited to the specific embodiments thereof except as defined in the appended claims.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A high-voltage discharge lamp comprising:

a bulb made of quartz glass and having seal portions;

a pair of opposing electrodes;

molybdenum foils joined to respective ones of said opposing electrodes; and cylindrical members covering joints in the seal portions, as well as the vicinities thereof, between said molybdenum foils and respective ones of said opposing electrodes, said cylindrical members having slits formed on at least one of an outer surface and an inner surface thereof.

said opposing electrodes, said molybdenum foils and said cylindrical members being hermetically sealed within said bulb at the seal portions thereof.

2. The high-voltage discharge lamp according to claim 1, wherein said slits are formed helically on the outer surface of said cylindrical members.

3. The high-voltage discharge lamp according to claim 2, wherein said cylindrical members are made of tungsten.

4. The high-voltage discharge lamp according to claim 1, wherein said cylindrical members are made of tungsten.

5. The high-voltage discharge lamp according to claim 1, wherein said slits extend longitudinally of the cylindrical members.

6. The high-voltage discharge lamp according to claim 1, wherein said slits extend circumferentially of the cylindrical members.

7. The high-voltage discharge lamp according to claim 1, wherein said joints in the seal portions are substantially at the mid-point between said molybdenum foils and respective ones of said opposing electrodes.

8. The high-voltage discharge lamp according to claim 1, wherein said cylindrical members comprise mesh numbers with a periphery composed of minute frames and devoid of projections.

9. A high-voltage discharge lamp comprising:

a bulb made of quartz glass and having seal portions;

a pair of opposing electrodes;

molybdenum foils joined to respective ones of said opposing electrodes; and mesh members covering joints in the seal portions, as well as the vicinities thereof, between said molybdenum foils and respective ones of said opposing electrodes, said opposing electrodes, said molybdenum foils and said mesh members being hermetically sealed within said bulb at the seal portions thereof.

10. The high-voltage discharge lamp according to claim 9, wherein said mesh members are made of tungsten.

11. The high-voltage discharge lamp according to claim 9, wherein said mesh members are substantially cylindrical.

12. A high-voltage discharge lamp comprising:

a bulb made of quartz glass and having seal portions;

a pair of opposing electrodes;

molybdenum foils joined to respective ones of said opposing electrodes; and cylindrical members covering joints in the seal portions, as well as the vicinities thereof, between said molybdenum foils and respective ones of said opposing electrodes, said cylindrical members having slits on an inner surface thereof, said opposing electrodes, said molybdenum foils and said cylindrical members being hermetically sealed within said bulb at the seal portions thereof.

13. The high-voltage discharge lamp according to claim 12, wherein said cylindrical members include slits formed on an outer surface thereof.

* * * * *